US008531384B2

(12) United States Patent
Kwon et al.

(10) Patent No.: US 8,531,384 B2
(45) Date of Patent: Sep. 10, 2013

(54) DRIVING METHOD FOR LOCAL DIMMING OF LIQUID CRYSTAL DISPLAY DEVICE AND APPARATUS USING THE SAME

(75) Inventors: Kyung-Joon Kwon, Seoul (KR); Dong-Woo Kim, Seoul (KR); Chang-Kyun Park, Icheon (KR)

(73) Assignee: LG Display Co., Ltd., Seoul (KR)

( * ) Notice: Subject to any disclaimer, the term of this patent is extended or adjusted under 35 U.S.C. 154(b) by 561 days.

(21) Appl. No.: 12/836,372

(22) Filed: Jul. 14, 2010

(65) Prior Publication Data

US 2011/0141004 A1 Jun. 16, 2011

(30) Foreign Application Priority Data

Dec. 11, 2009 (KR) ..... 10-2009-0123193

(51) Int. Cl.
*G09G 3/36* (2006.01)

(52) U.S. Cl.
USPC ..... 345/102

(58) Field of Classification Search
USPC ..... 345/102
See application file for complete search history.

(56) References Cited

U.S. PATENT DOCUMENTS

2007/0279373 A1* 12/2007 Tseng et al. ..... 345/102
2009/0021469 A1* 1/2009 Yeo et al. ..... 345/102
2009/0267926 A1* 10/2009 Seo et al. ..... 345/204

FOREIGN PATENT DOCUMENTS

CN 101494033 A 7/2009
KR 1020090058205 6/2009

OTHER PUBLICATIONS

Office Action issued in corresponding Chinese Patent Application No. 201010299826.4, mailed Jul. 18, 2012.

* cited by examiner

*Primary Examiner* — Chanh Nguyen
*Assistant Examiner* — Tsegaye Seyoum
(74) *Attorney, Agent, or Firm* — Brinks Hofer Gilson & Lione

(57) ABSTRACT

A driving method for local dimming of a Liquid Crystal Display (LCD) device and an apparatus using the same are disclosed. The driving method includes assigning a first block index to each of a plurality of blocks into which backlight unit is divided, detecting a connection order of the blocks in the backlight unit, arranging the first block indexes according to the block connection order, storing first block index ordering information that specifies the arranged first block indexes, retrieving the stored first block index ordering information, generating second block index information that specifies second block indexes corresponding to the first block indexes of the backlight unit, determining a local dimming value for each block by analyzing input data on a block basis according to the second block index information, rearranging the local dimming values arranged based on the second block index information according to the first block index ordering information, and driving the plurality of blocks respectively using the rearranged local dimming values of the plurality of blocks.

9 Claims, 6 Drawing Sheets

DRIVING METHOD FOR LOCAL DIMMING OF LIQUID CRYSTAL DISPLAY DEVICE AND APPARATUS USING THE SAME

This application claims the benefit of Korean Patent Application No. 10-2009-0123193, filed on Dec. 11, 2009, which is hereby incorporated by reference as if fully set forth herein.

BACKGROUND

1. Field of the Disclosure

The present disclosure relates to a Liquid Crystal Display (LCD) device, and more particularly, to a driving method for local dimming of an LCD device, which can be adaptively applied to the connection order of light emitting blocks of a backlight unit, and an apparatus using the same.

2. Discussion of the Related Art

Recently, flat panel displays have been popular as video displays, such as LCDs, Plasma Display Panels (PDPs), Organic Light Emitting Diodes (OLEDs), etc.

An LCD device includes a liquid crystal panel for displaying an image on a pixel matrix relying on the electrical and optical characteristics of liquid crystals that exhibit anisotropy in dielectric constant and refractive index, a driving circuit for driving the liquid crystal panel, and a backlight unit for irradiating light onto the liquid crystal panel. The gray scale of each pixel is adjusted by controlling the transmittance of light that passes from the backlight unit through the liquid crystal panel and polarizers through changing the orientation of liquid crystals according to a data signal.

In the LCD device, the luminance of each pixel is determined by the product between the luminance of the backlight unit and the light transmittance of liquid crystals that depends on data. The LCD device employs backlight dimming method for the purposes of increasing a contrast ratio and reducing power consumption. The backlight dimming method analyzes input image data and then modulates the image data and adjust a dimming value, for controlling the luminance of the backlight unit, according to the analyzed result. A Light Emitting Diode (LED) backlight unit using LEDs as light source has recently been used. The LEDs boast of high luminance and low power consumption, compared to conventional lamps. Because the LED backlight unit allow for location-based control, they may be driven by local dimming. According to the local dimming technology, the LED backlight unit is divided into a plurality of light emitting blocks and luminance is controlled on a bock-by-block basis. Local dimming may further increase the contrast ratio and decrease the power consumption since the backlight unit and the liquid crystal panel are divided into a plurality of blocks, local dimming values are decided by analyzing data on a block basis, and data is compensated based on the local dimming values.

The LCD device includes a local dimming driver (a driving chip) for driving for local dimming of the LCD device. The local dimming driver generates indexes for respective blocks to facilitate data analysis and luminance control on a block basis, and analyzes data and controls luminance according to the indexes of blocks. While it is preferable to fabricate backlight unit in such a manner that the indexes of blocks in the local dimming driver follow the block connection order of the backlight unit, the block connection order of the backlight unit does not coincide with block indexing information of the local dimming driver due to easiness in backlight fabrication and a bandwidth in which dimming data is transmitted, in most cases.

In case the block connection order of the backlight does not coincide with the indexes of blocks in the local dimming driver of the related art, a microcomputer is provided along with a backlight driver in a driver board in order to rearrange dimming values received in the order of block indexes from the local dimming driver according to the block connection order and sequentially provide the rearranged dimming values to the backlight driver. However, as many microcomputers as backlight drivers should be used, when the backlight unit is divided into at least two ports and driven on a port basis along with the trend toward a large liquid crystal panel and large backlight unit. Therefore, fabrication cost is increased. Moreover, a microcomputer for each port is capable of only converting indexes within the port, not capable of converting indexes in other ports that it is not responsible for. Accordingly, this scheme is not applicable to backlight unit with a different block connection order or a different port division structure.

SUMMARY

A driving method for local dimming of an LCD device includes assigning a first block index to each of a plurality of blocks into which backlight unit are divided, detecting a connection order of the blocks in the backlight unit, arranging the first block indexes according to the block connection order, storing first block index ordering information that specifies the arranged first block indexes, retrieving the stored first block index ordering information, generating second block index information that specifies second block indexes corresponding to the first block indexes of the backlight unit, determining a local dimming value for each block by analyzing input data on a block basis according to the second block index information, rearranging the local dimming values arranged based on the second block index information according to the first block index ordering information, and driving the plurality of blocks respectively using the rearranged local dimming values of the plurality of blocks.

In another aspect, an apparatus for controlling local dimming of an LCD device includes backlight unit divided into a plurality of blocks each being assigned a first block index, a memory for storing first block index ordering information that specifies the first block indexes of the blocks arranged according to a connection order of the blocks, a local dimming driver for retrieving the first block index ordering information from the memory, generating second block index information that specifies second block indexes corresponding to the first block indexes of the backlight unit, determining a local dimming value for each block by analyzing input data on a block basis according to the second block index information, rearranging the local dimming values arranged based on the second block index information according to the first block index ordering information, and outputting the rearranged local dimming values, and a backlight driver for driving the plurality of blocks respectively using the rearranged local dimming values of the plurality of blocks.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE EXEMPLARY EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Figure 1:
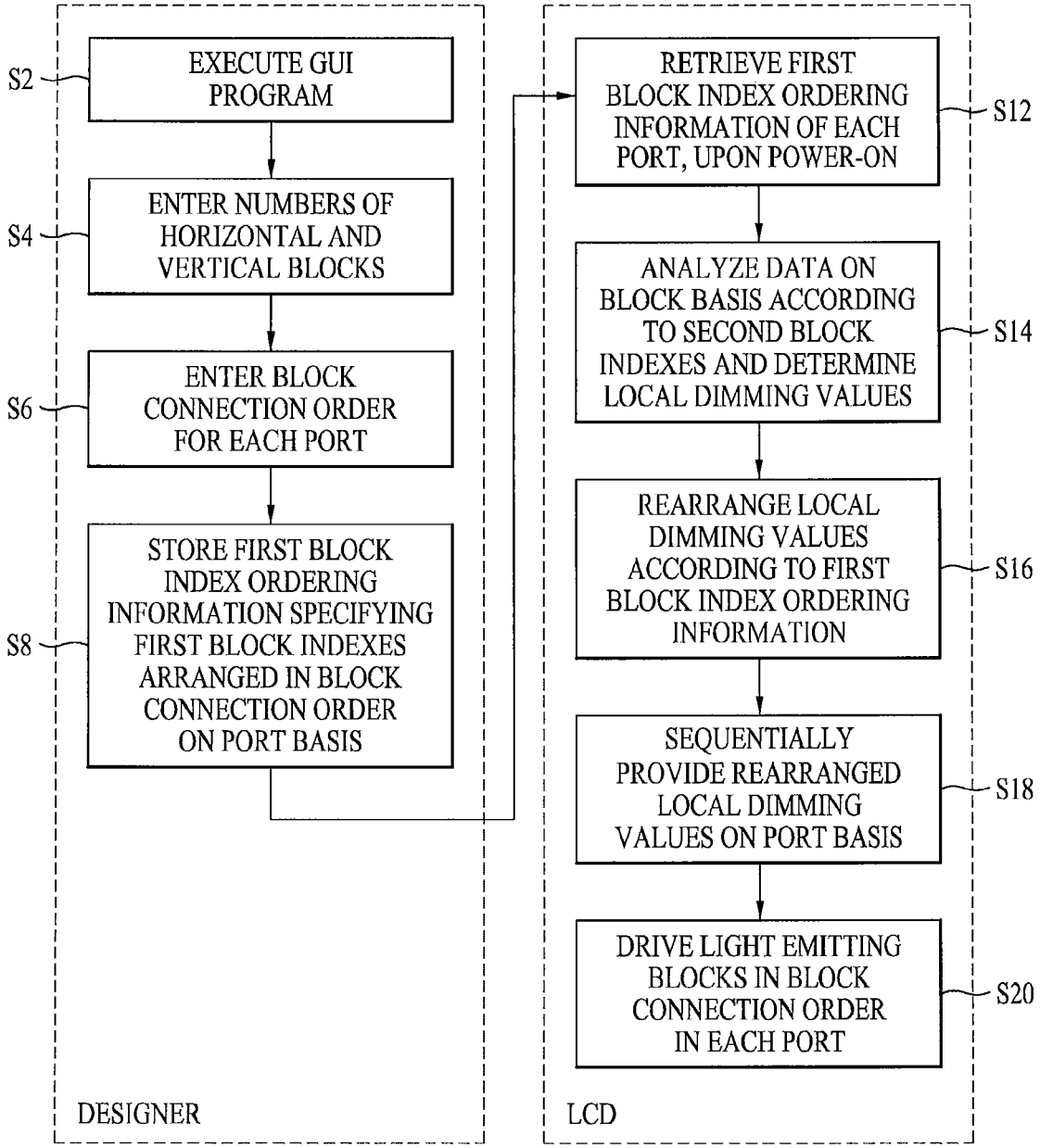
FIG. 1 is a flowchart illustrating a driving method for local dimming of a Liquid Crystal Display (LCD) device according to an exemplary embodiment of the present invention.

FIG. 1 is a flowchart illustrating a driving method for local dimming of a Liquid Crystal Display (LCD) device according to an exemplary embodiment of the present invention.

Referring to FIG. 1, a designer stores block index ordering information (first block index ordering information) that specifies the indexes of blocks of backlight unit, arranged according to a serial connection order of light emitting blocks on a port basis in an internal memory of the LCD device, which memorizes various setting values of a local dimming driver, for example, in an Electrically Erasable and Programmable Read Only Memory (EEPROM) in steps S2 to S8.

More specifically, the designer executes a Graphic User Interface (GUI) program at a computer in step S2 and generates a light emitting block matrix on a port basis by entering the numbers of horizontal and vertical blocks of the backlight unit on a GUI screen in step S4. For example, when the designer enters "10" and "8" as the numbers of horizontal and vertical blocks of the backlight unit, a 10×8 block matrix is generated and displayed for each port.

Figure 2:
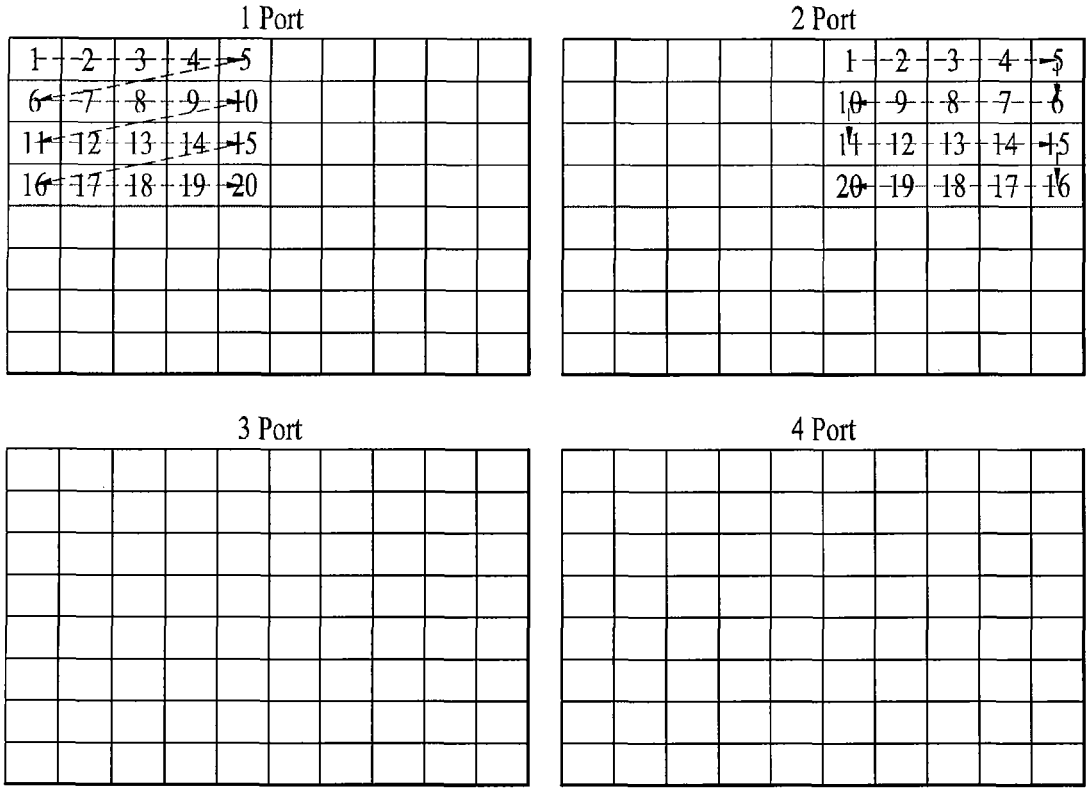
FIG. 2 illustrates an exemplary screen on which block connection order values are entered on a port basis in step S6 illustrated in FIG. 1.
Figure 3:
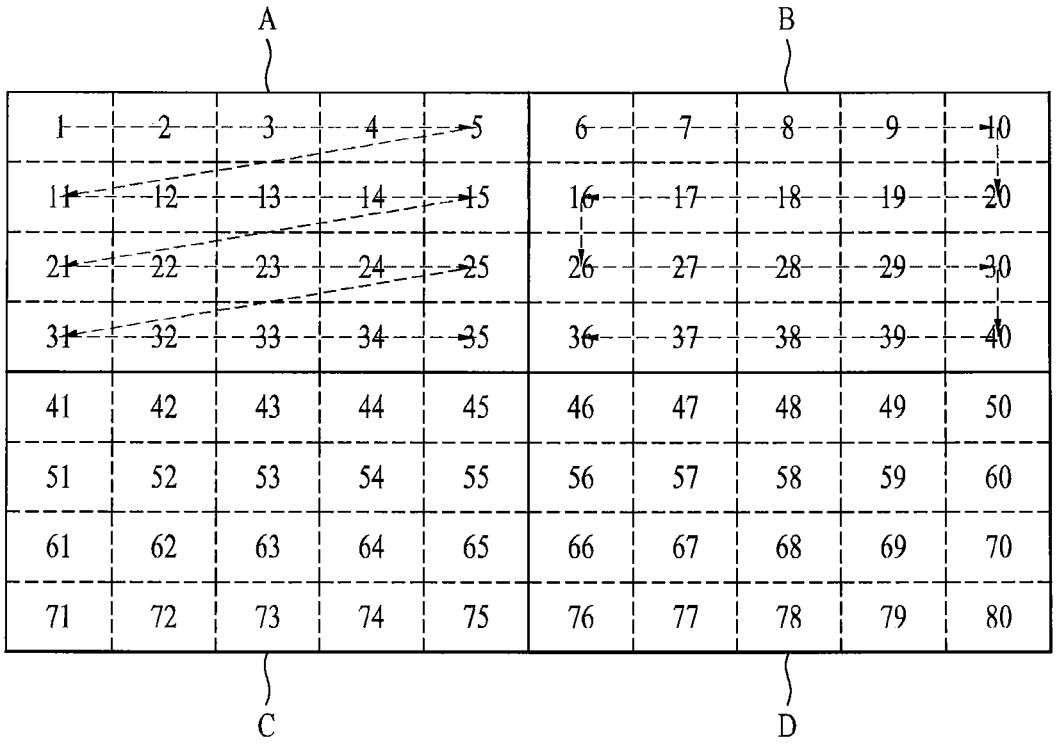
FIG. 3 illustrates exemplary first block indexes arranged according to a block connection order for each port of backlight unit applied to the present invention.

In step S6, the designer detects the connection order of light emitting blocks in each port of the backlight unit and enters a connection order value in each block on a block basis on the GUI screen, so that the GUI program arranges first block indexes of the backlight unit according to the block connection order values entered on a port basis, as illustrated in FIG. 2. In general, each of a plurality of light emitting blocks that form the backlight unit has its unique first block index, as illustrated in FIG. 3. Then, the GUI program accesses the internal memory by data communication between the computer and the internal memory of the LCD device and stores information about the first block indexes (i.e. the first block index ordering information) arranged according to the block connection order values on a port basis in step S8.

For example, if the backlight unit is of a 10×8 block matrix and divided into four ports so that the backlight unit is driven on a port basis, a first port A (Port 1) has serially connected 20 blocks having first block indexes 1 to 5, 11 to 15, 21 to 25, and 31 to 35, a second port B (Port 2) has serially connected 20 blocks having first block indexes 6 to 10, 16 to 20, 26 to 30, and 36 to 40, a third port C (Port 3) has serially connected 20 blocks having first block indexes 41 to 45, 51 to 55, 61 to 65, and 71 to 75, and a fourth port D (Port 4) has serially connected 20 blocks having first block indexes 46 to 50, 56 to 60, 66 to 70, and 76 to 80. If block connection order values are entered in an ascending order from left to right for the first port A and in an ascending order alternating between a left to right direction and a right to left direction for the second port B, as illustrated in FIG. 2, first block indexes are arranged according to the block connection orders (in arrowed directions) for the individual ports A and B, as illustrated in FIG. 3, and first block index ordering information about the ports A and B is stored in the memory of the LCD device, as illustrated in Table 1 below.

TABLE 1

| | | | | | | | | | | |
|---|---|---|---|---|---|---|---|---|---|---|
| Port 1 | 1 | 2 ... | 5 | 11 | 12 ... 15 | 21 | 22 ... 25 | 31 | 32 ... 35 |
| Port 2 | 6 | 7 ... | 10 | 16 | 17 ... 20 | 26 | 27 ... 30 | 36 | 37 ... 40 |

In the same manner, block connection order values are entered on the input screen of the GUI program for the third port C and the fourth port D and thus first block index ordering information that specifies block indexes arranged according to the block connection order values is stored for the individual third and fourth ports C and D in the memory of the LCD device.

Then, upon power-on, the LCD device determines a local dimming value for each block according to second block index information of the local dimming driver, rearranges the local dimming values of blocks according to the first block index ordering information of the backlight unit stored beforehand in the memory, and provides the rearranged local dimming values to the respective backlight drivers in steps S12 to S20. Thus, each backlight driver controls luminance on a block basis by driving light emitting blocks in a block connection order using the received local dimming values.

Figure 4:
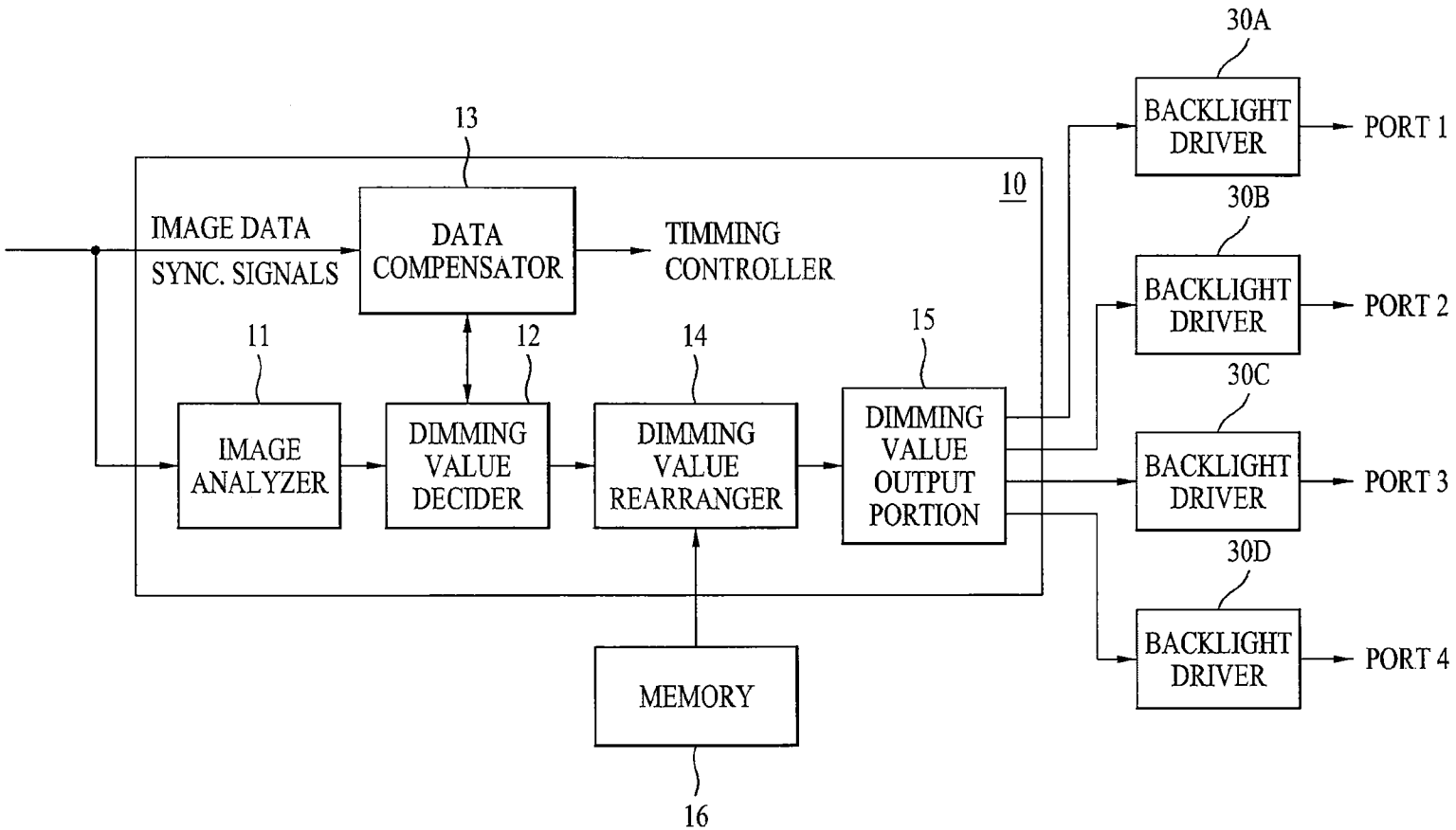
FIG. 4 is a block diagram of a local dimming control apparatus in an LCD device according to an exemplary embodiment of the present invention.

FIG. 4 is a block diagram of a local dimming control apparatus in an LCD device according to an exemplary embodiment of the present invention.

Referring to FIG. 4, the local dimming control apparatus includes a local dimming driver 10, a memory 16, and a plurality of backlight drivers 30A to 30D.

The local dimming driver 10 analyzes data for each light emitting block of backlight unit, determines a local dimming value for each block according to the result of the analysis, and modulates the data using the local dimming values of blocks. For this purpose, the local dimming driver 10 includes an image analyzer 11, a dimming value decider 12, a data compensator 13, a dimming value rearranger 14, and a dimming value output portion 15.

The image analyzer 11 generates second block index information corresponding to first block index ordering information about the backlight unit to divide one frame of an image into units corresponding to the light emitting blocks of the backlight unit, divides the input data into blocks in response to the second block index information, and analyzes the data on a block basis. The image analyzer 11 may calculate a representative value (a maximum gray level or a maximum luminance value) for each pixel, average the representative values of pixels in each block, and output the average as a representative value of the block. Alternatively, the image analyzer 11 may sum the representative values of pixels in each block and output the sum as the representative value of the block.

The dimming value decider 12 determines a local dimming value for each block corresponding to the representative value of the block received from the image analyzer 11. For this purpose, the dimming value decider 12 has a look-up table in which local dimming values are preliminarily mapped to representative values for blocks. The dimming value decider 12 outputs the local dimming values of respective blocks according to the order of second block indexes to the dimming value rearranger 14.

The data compensator 13 compensates for a decreased luminance in the input image data by modulating the input image data according to the local dimming value of each block received from the dimming value decider 12, and outputs the compensated data to a timing controller.

The dimming value rearranger 14 rearranges the local dimming values arranged according to the order of second block indexes, received from the dimming value decider 12, on a port basis based on the first block index ordering information of each port retrieved from the memory 16, that is, according to the block connection order of each port, and outputs the rearranged local dimming values to the dimming value output portion 15. Therefore, the dimming value rearranger 14 may rearrange the local dimming values of individual blocks in the block connection order of each port illustrated in FIG. 3 and output the rearranged local dimming values of each port to the dimming value output portion 15.

The dimming value output portion 15 serializes the port-based rearranged local dimming values received from the dimming value rearranger 14 and provides the serial local dimming values to the backlight drivers 30A to 30D on a port basis.

Figure 5:
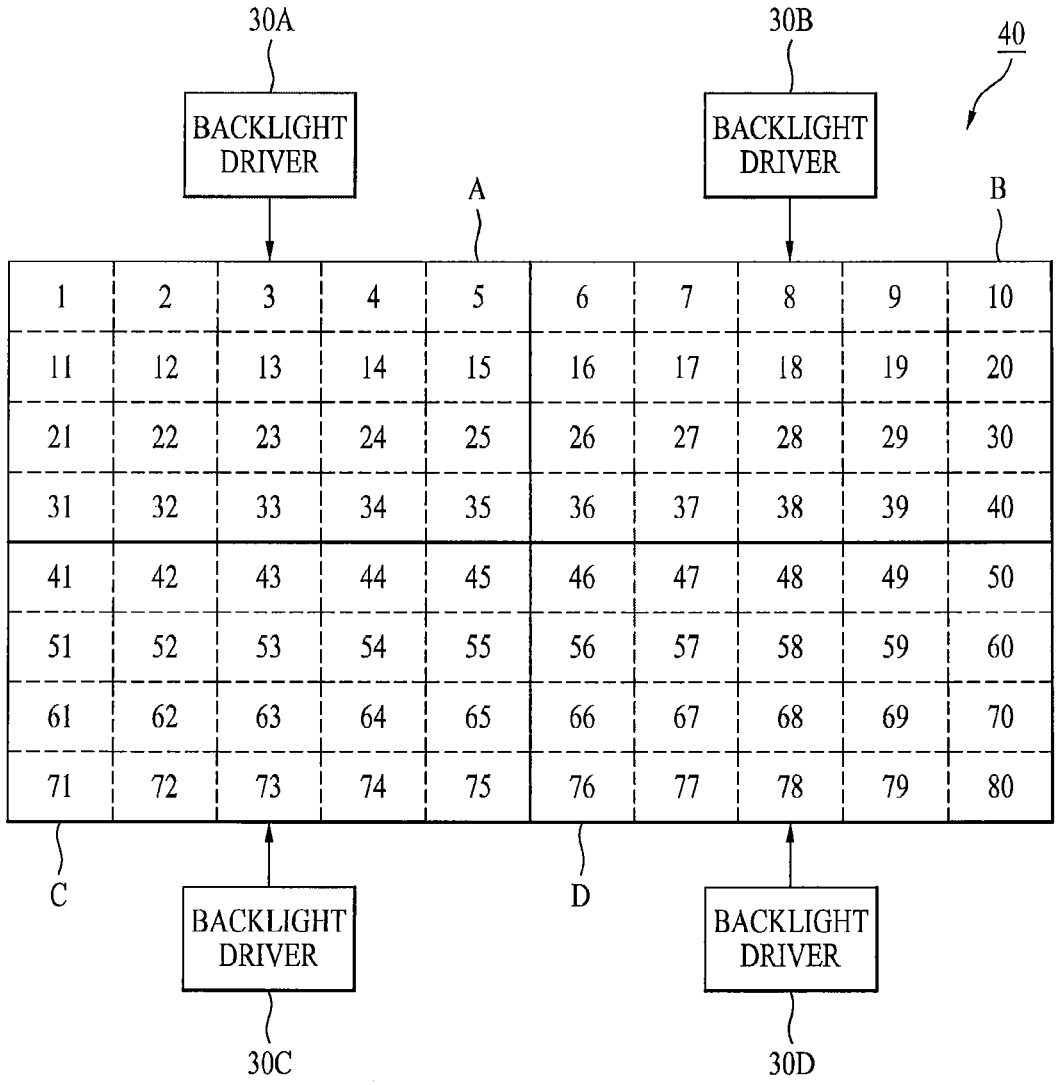
FIG. 5 illustrates exemplary backlight unit and backlight drivers applied to the present invention.

The backlight drivers 30A to 30D are connected to the plurality of ports A to D of a backlight unit 40, respectively, as illustrated in FIG. 5. Each of the backlight drivers 30A to 30D sequentially drives the light emitting blocks of a port corresponding to the backlight driver using the local dimming values received in the block connection order of the port from the local dimming driver 10, thus controlling the luminance of backlight unit on a block basis.

Figure 6:
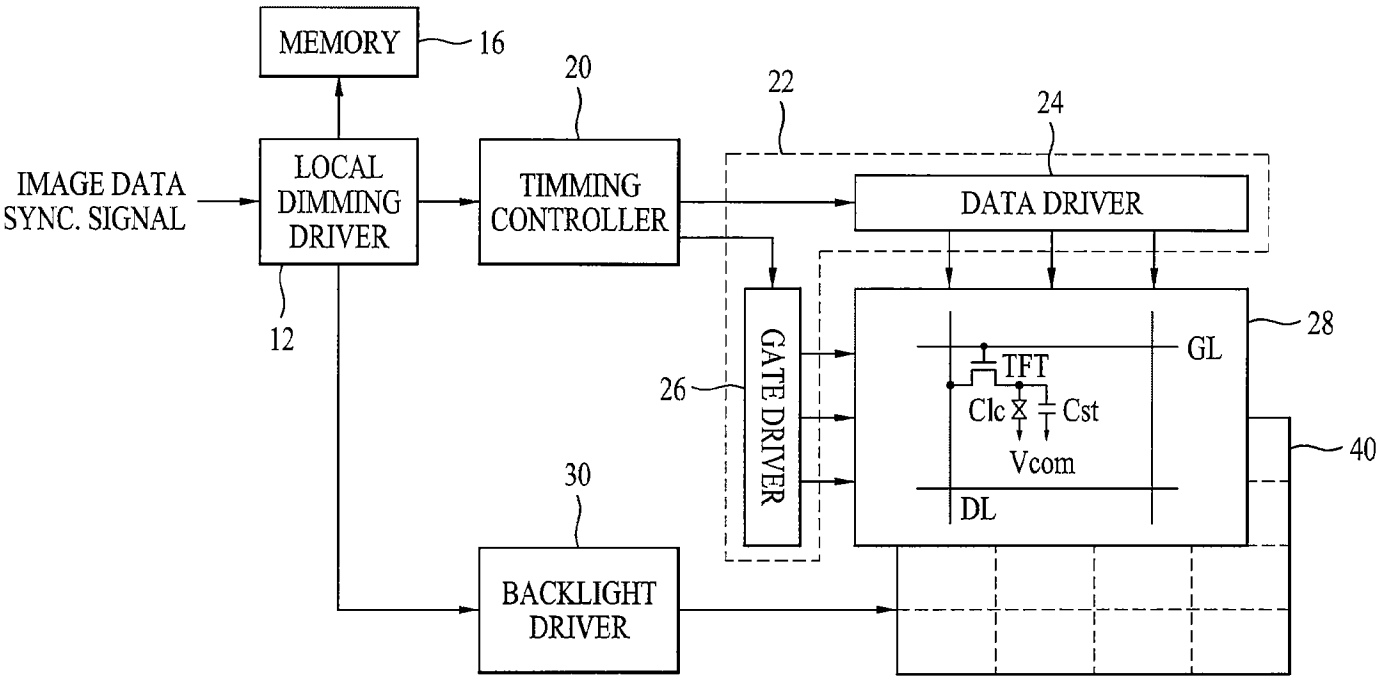
FIG. 6 is a block diagram of an LCD device according to an exemplary embodiment of the present invention.

FIG. 6 is a block diagram of an LCD device to which the local dimming driver 10 illustrated in FIG. 4 is applied according to an exemplary embodiment of the present invention.

Referring to FIG. 6, the LCD device includes the local dimming driver 10 for determining a local dimming value for each block by analyzing input image data on a block basis and modulating data using the local dimming value of each block, a timing controller 20 for providing the data received from the local dimming driver 12 to a panel driver 22 and controlling a driving timing of the panel driver 22, a backlight driver 30 for driving an LED backlight unit 40 on a block basis based on the local dimming value of each block received from the local dimming driver 10, and a liquid crystal panel 28 driven by a data driver 24 and a gate driver 26 of the panel driver 22. The local dimming driver 10 may be provided inside the timing controller 20.

In operation, the local dimming driver 10 analyzes input image data on a block basis using synchronization signals, determines a local dimming value for each block according to the analysis result, and modulates the data. Specifically, the local dimming driver 10 retrieves first block index ordering information specifying first block indexes arranged according to the light emitting block connection order of each port of the LED backlight unit 40 from a memory 16, determines local dimming values by analyzing the data on a block basis according to internally generated second block index information, rearranges the local dimming values according to the first block index ordering information, and outputs the rearranged dimming values separately on a port basis to the backlight driver 30.

The timing controller 20 arranges the data received from the local dimming driver 10 and outputs the arranged data to the data driver 24 of the panel driver 22. The timing controller 20 generates data control signals for controlling driving timings of the data driver 24 and gate control signals for controlling driving timings of the gate driver 26, using a plurality of synchronization signals received from the local dimming driver 10, specifically a vertical synchronization signal, a horizontal synchronization signal, a data enable signal, and a dot clock signal, and outputs the data control signals and the gate control signals respectively to the data driver 24 and the gate driver 26. Meanwhile, the timing controller 20 may further include an overdriving circuit (not shown) for modulating data by applying an overshoot value or an undershoot value to the data according to a data difference between successive frames in order to increase the response speed of liquid crystals.

The panel driver 22 includes the data driver 24 for driving data lines DL of the liquid crystal panel 28 and gate lines GL of the liquid crystal panel 28.

The data driver 24 converts digital video data received from the timing controller 24 to analog data signals (pixel voltage signals) using gamma voltages in response to the data control signals received from the timing controller 20 and provides the analog data signals to the data lines DL of the liquid crystal panel 28.

The gate driver 26 sequentially drives the gate lines GL of the liquid crystal panel 28 in response to the gate control signals received from the timing controller 20.

The liquid crystal panel 28 displays an image through a pixel matrix having a plurality of pixels arranged. Each pixel represents a desired color by combining red, green and blue sub-pixels that control light transmittance through changing the orientation of the liquid crystals according to a luminance-compensated data signal. Each of the sub-pixels includes a Thin Film Transistor (TFT) connected to a gate line GL and a data line DL, and a liquid crystal capacitor Clc and a storage capacitor Cst that are connected to the TFT in parallel. The liquid crystal capacitor Clc is charged with a different voltage between a data signal supplied to a pixel electrode through the TFT and a common voltage Vcom supplied to a common electrode and drives a liquid crystal according to the charged voltage, to thereby control light transmittance. The storage capacitor Cst maintains the voltage charged at the liquid crystal capacitor Clc to be stable.

The backlight driver 30 drives the LED backlight unit 40 on a block basis according to the local dimming value of each block received from the local dimming driver 10, thus controlling the luminance of the LED backlight unit 40 on a block basis. If the LED backlight unit 40 is divided into a plurality of ports, a plurality of backlight drivers 30 may be provided to drive the plurality of ports independently. The backlight driver 30 generates a Pulse Width Modulation (PWM) signal with a duty ratio corresponding to the local dimming value of each block on a block basis and provides an LED driving signal corresponding to the PWM signal for each block to the block, thereby driving the LED backlight unit 40 on a block basis. The backlight driver 30 sequentially drives the light emitting blocks using local dimming values received from the local dimming driver 10 in a block connection order, thus controlling the luminance of the backlight unit on a block basis.

As is apparent from the above description, the driving method for local dimming of an LCD device and an apparatus using the same according to the present invention preset first block index ordering information that specifies first block indexes of backlight unit arranged according to the serial connection order of light emitting blocks, for each port of the backlight unit, and store the first block index ordering information in an internal memory of the LCD device. Upon power-on, the LCD device retrieves the first block index ordering information from the memory, determines a local dimming value for each block by analyzing data on a block basis according to second block index information, rearranges the local dimming values of blocks according to the first block index ordering information, and provides the rearranged local dimming values to respective backlight drivers. Thus each port can control luminance by driving light emitting blocks according to a block connection order. As a consequence, there is no need for a microcomputer for rearranging the local dimming values at a front end of each backlight driver, thereby reducing fabrication cost.

In addition, since the first block index ordering information stored in the memory of the LCD device can be updated according to a request of the designer, the present invention is compatibly applied to various backlight structures simply by updating the first block index ordering information, when the backlight unit is changed.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A driving method for local dimming of a Liquid Crystal Display (LCD) device, comprising:

assigning a first block index to each of a plurality of blocks into which backlight unit is divided;

detecting a connection order of the plurality of blocks in the backlight unit, arranging the first block indexes according to the connection order of the plurality of blocks, and storing first block index ordering information that specifies the arranged first block indexes;

retrieving the stored first block index ordering information;

generating second block index information that specifies second block indexes corresponding to the first block indexes of the backlight unit;

determining a local dimming value for each block by analyzing input data on a block basis according to the second block index information;

rearranging the local dimming values arranged based on the second block index information according to the first block index ordering information; and driving the plurality of blocks respectively using the rearranged local dimming values of the plurality of blocks.

2. The driving method according to claim 1, wherein the backlight unit is divided into a plurality of ports each port having a plurality of serially connected blocks, and the detection of a connection order of the plurality of blocks, arrangement of the first block indexes according to the connection order of the plurality of blocks, and storage of first block index ordering information comprises detecting a block connection order on a port basis, arranging the first block indexes according to the detected block connection orders on a port basis, and storing first block index ordering information specifying the arranged first block indexes for each of the ports.

3. The driving method according to claim 2, wherein a designer enters the connection order of the plurality of blocks on a port basis through a Graphic User Interface (GUI) and the first block indexes of each port are arranged according to the entered block connection order of the port.

4. The driving method according to claim 2, wherein the rearrangement of the local dimming values comprises rearranging the local dimming values arranged based on the second block index information according to the first block index ordering information of each port and outputting the rearranged local dimming values separately on a port basis.

5. The driving method according to claim 2, further comprising, when the backlight unit is changed, updating the first block index ordering information for the changed backlight unit by performing the first block index assignment, the block connection order detection, the first block index arrangement, and the storage of first block index ordering information.

6. An apparatus for controlling local dimming of a Liquid Crystal Display (LCD) device, comprising:

backlight unit divided into a plurality of blocks each being assigned a first block index;

a memory that stores first block index ordering information that specifies the first block indexes of the plurality of blocks arranged according to a connection order of the plurality of blocks;

a local dimming driver that retrieves the first block index ordering information from the memory, generates second block index information that specifies second block indexes corresponding to the first block indexes of the backlight unit, determines a local dimming value for each block by analyzing input data on a block basis according to the second block index information, rearranges the local dimming values arranged based on the second block index information according to the first block index ordering information, and outputs the rearranged local dimming values; and a backlight driver that drives the plurality of blocks respectively using the rearranged local dimming values of the plurality of blocks.

7. The apparatus according to claim 6, wherein the backlight unit is divided into a plurality of ports each port having a plurality of serially connected blocks, the backlight driver includes a plurality of second backlight drivers that drive the plurality of ports respectively, and the memory stores first block index ordering information that specifies first block indexes according to a block connection order on a port basis.

8. The apparatus according to claim 7, wherein the local dimming driver rearranges the local dimming values arranged based on the second block index information according to the first block index ordering information of each port and outputting the rearranged local dimming values separately to the plurality of second backlight drivers on a port basis.

9. The apparatus according to claim 7, wherein when the backlight unit is changed, the memory is updated to first block index ordering information for the changed backlight unit.

* * * * *